US006369774B1

(12) United States Patent
Lucidarme

(10) Patent No.: US 6,369,774 B1
(45) Date of Patent: Apr. 9, 2002

(54) RADIO COMMUNICATION BASE STATION ANTENNA

(75) Inventor: Thierry Lucidarme, Montigny-le-Bretonneux (FR)

(73) Assignee: Nortel Networks S.A. (FR)

( * ) Notice: Subject to any disclaimer, the term of this patent is extended or adjusted under 35 U.S.C. 154(b) by 0 days.

(21) Appl. No.: 09/762,795

(22) PCT Filed: Jun. 14, 2000

(86) PCT No.: PCT/FR00/01646

§ 371 Date: Feb. 9, 2001

§ 102(e) Date: Feb. 9, 2001

(87) PCT Pub. No.: WO00/79643

PCT Pub. Date: Dec. 28, 2000

(30) Foreign Application Priority Data

Jun. 18, 1999 (FR) ..... 99 07744

(51) Int. Cl.[7] ..... H01Q 1/12
(52) U.S. Cl. ..... 343/890; 343/872; 343/893
(58) Field of Search ..... 343/872, 890, 343/891, 893, 770, 700 MS, 853, 793

(56) References Cited

U.S. PATENT DOCUMENTS

| | | | | |
|---|---|---|---|---|
| 4,008,477 A | | 2/1977 | Babij et al. | 343/701 |
| 5,038,151 A | | 8/1991 | Kaminski | 343/727 |
| 5,155,493 A | | 10/1992 | Thursby et al. | 343/700 MS |
| 5,453,754 A | | 9/1995 | Fray | 343/789 |
| 5,528,254 A | | 6/1996 | Hwong et al. | 343/873 |
| 5,757,324 A | * | 5/1998 | Helms et al. | 343/700 MS |
| 5,912,646 A | * | 6/1999 | Seki et al. | 343/700 MS |

FOREIGN PATENT DOCUMENTS

| | | | |
|---|---|---|---|
| EP | 0 791 977 | 8/1997 | H01Q/9/16 |
| EP | 0 802 579 | 10/1997 | H01Q/21/28 |
| GB | 1 074 193 | 6/1967 | H01Q/15/14 |
| GB | 1 555 756 | 11/1979 | H01Q/9/04 |

OTHER PUBLICATIONS

Yang H Y et al., "Gain Enhancement Methods for Printed Circuit Antennas Through Multiple Superstrates", IEEE Transactions on Antennas and Propagation, New York, USA, vol. 35, No. 7, Jul. 1987, p. 860–863.

Jackson D R et al., "Gain Enhancement Methods for Printed Circuit Antennas", IEEE Transactions on Antennas and Propagation, USA, vol. 33, No. 9, Sep. 1985, p. 976–987.

* cited by examiner

*Primary Examiner*—Don Wong
*Assistant Examiner*—Hoang Nguyen
(74) *Attorney, Agent, or Firm*—Piper Marbury Rudnick & Wolfe

(57) ABSTRACT

The antenna comprises several primary sources (6A–6C) fed independently and arranged to have different radiation characteristics. These primary sources are placed in a first medium (7A–7C) so as to be spatially decoupled. A second medium (8A–8C), of a characteristic impedance substantially lower than the first medium covers the first medium. Each primary source has a direction of focus (A–C) perpendicular to the interface between the first and second media, along which the distance ($d_1$) between said primary source and said interface is $\lambda_1.(2p_1-1)/4$ and the second medium has a thickness ($e_2$) equal to $\lambda_2.(2p_1-1)/4$, where $\lambda_1$ and $\lambda_2$ denote the wavelengths radiated by said primary source in the first and second media, respectively, and $p_1$ and $p_2$ are integers.

15 Claims, 3 Drawing Sheets

RADIO COMMUNICATION BASE STATION ANTENNA

BACKGROUND OF THE INVENTION

The present invention relates to the antennas used with base stations for radio communication.

The take-off in cellular mobile communications has necessitated the installation of a large number of base stations. Cellular operators may encounter difficulties in finding appropriate sites. Apart from the problem of site availability, there is also the nuisance problem as perceived by the public due to the size and unattractive appearance of base station antennas which, of course, have to be positioned high up and clearly visible for the network effeciency. In certain countries, regulations or taxes have been introduced with a view to restricting the number of these antennas.

Using multi-sector antennas enables the number of base station sites to be reduced for a given coverage (see EP-A-0 802 579). However, due to their directivity and multiplicity, these multi-sector antennas are considerably larger than omnidirectional antennas.

In order to increase the gain in directivity of a base station antenna, an array of radiating elements is used, disposed in a specific manner relative to the wavelength to be transmitted and fed by the same radio signals to which appropriate phase shift and amplitude laws are applied. The greater the gain in directivity sought, the larger the array has to be. The order of magnitude of the size of each radiating element is determined by the wavelength transmitted, i.e. in the decimetric range, and their arrayed arrangement leads to antennas that may be one to several meters in dimension.

The difficulties outlined above are further aggravated by the deployment of networks using different wavelength ranges. In Europe, for example, second generation digital systems use a band near 900 MHz (GSM, <<Global System for Mobile communications>>) and a band near 1800 MHz (DCS, <<Digital Cellular System>>), and future third generation systems (UMTS, <<Universal Mobile Telecommunication System>>) will use a frequency band near 2000 MHz. In order put in place an infrastructure for a new type of network, an operator who is already operating a different type of network has to provide new antennas. Either he will have to secure new sites or he will have to install more antennas on existing sites. In either case, there will be more antennas.

Furthermore, installing antennas operating in frequency ranges whose ratio is a small integer on the same site causes isolation problems due to the reception by one antenna of harmonics of the frequencies transmitted by another antenna. This situation will arise in the case of the GSM and DCS bands, for which, it is considered that the antennas, already cumbersome, must be spaced at least 50 centimeters apart.

A main object of the present invention is to propose an antenna arrangement that will enable radiating elements having different radiation characteristics (in terms of directivity and/or frequency) to be used together in a relatively compact layout in order to limit the difficulties outlined above.

Accordingly, the invention proposes an antenna for a radio communication base station, comprising several primary sources fed independently and arranged to have different radiation characteristics, the primary sources being placed in a first medium so as to be spatially decoupled. According to the invention, the antenna further comprises at least one second medium covering the first medium and having a substantially lower characteristic impedance than the first medium. Each primary source has at least one direction of focus perpendicular to the interface between the first and second medium, along which the distance between said primary source and said interface is substantially equal to $\lambda_1.(2p_1-1)/4$ and the second medium has a thickness substantially equal to $\lambda_2.(2p_2-1)/4$, where $\lambda_1$ and $\lambda_2$ denote the wavelengths radiated by said primary source in the first and second media, respectively, and $p_1$ and $p_2$ are integers.

The media surrounding the primary sources exhibit resonance conditions which procure a gain in directivity, in elevation and optionally in azimuth. The principle of physics underlying this resonance has been described in the case of conformed antennas in the article entitled <<Gain Enhancement Methods for Printed Circuit Antennas>> by D. R. Jackson et al., IEEE Transactions on Antennas and Propagation, Vol. AP-33, No. 9, September 1985, pages 976–987. The gain in amplitude obtained by the first and second media, having characteristic impedances $Z_{c1}$ and $Z_{c2}$ respectively, is in the order of $2.Z_{c1}/Z_{c2}$.

The characteristic impedance $Z_c$ of a medium with a relative dielectric constant $\in_r$ and a relative magnetic permeability $\mu_r$ is given by $$Z_c = Z_{c0} \cdot \sqrt{\frac{\mu_r}{\varepsilon_r}},$$

where $Z_{c0}=120\pi$. Consequently, the first and second media may have parameters $\in_r$ and $\mu_r$ adapted as a function of the desired gain.

In a preferred embodiment, adaptation will essentially focus on the dielectric constants $\in_r$, in order to use more readily available materials. Generally speaking, a medium with a high $\in_r$ will be used for the second medium and $\in_r \approx 1$ in the first medium so as to maximize the ratio $$Z_{c1}/Z_{c2} = \sqrt{\frac{\varepsilon_2 \cdot \mu_1}{\varepsilon_1 \cdot \mu_2}} \approx \sqrt{\frac{\varepsilon_2}{\varepsilon_1}}$$

(where $\in_r=\in_1$, $\mu_r=\mu_1$ in the first medium and $\in_r=\in_2$, $\mu_r=\mu_2$ in the second medium).

It is also possible to use composite materials, whereby the values of $\in_r$ and/or $\mu_r$ can be adjusted to suit requirements.

In order to further enhance the gain of the antenna, the first medium may be covered by a superposition of focusing layers, the first focusing layer, adjacent to the first medium, being formed by said second medium, and each focusing layer being formed by a medium of a thickness substantially equal to $\lambda_i.(2p_i-1)/4$ along the direction of focus of each of the primary sources, where $\lambda_i$ denotes the wavelength radiated by said primary source in the medium forming said focusing layer and $p_i$ is an integer. The i-th focusing layer is formed, for each odd integer i, by a medium having a characteristic impedance substantially lower than the media located on either side of said i-th focusing layer. In particular, the i-th focusing layer may be made up, for each odd integer i, of a medium having a $\in_r$ substantially higher than the media located on either side of this i-th focusing layer.

Increasing the number of focusing layers increases the gain in amplitude, which will be in the order of 2.

$$2\cdot\prod_{m=0}^{k}\frac{Z_{c(2m+1)}}{Z_{c(2m)}}$$

if there are 2k focusing layers over the central high impedance medium, and in the order of $$2\cdot\prod_{m=1}^{k}\frac{Z_{c(2m-1)}}{Z_{c(2m)}}$$

if there are 2k−1 focusing layers, $Z_{ci}$ denoting for $i\geqq 2$ the characteristic impedance of the (i-1)-th focusing layer (see H. Y. Yang et al., <<Gain Enhancement Methods for Printed Circuit Antennas through Multiple Superstrates>>, IEEE Transactions on Antennas and Propagation, Vol. AP-35, No. 7, July 1987, pages 860–863).

In one embodiment of the antenna according to the invention, the primary sources are fed and arranged to radiate at different wavelengths. The antenna is then adapted to sites where base stations operating in different frequency bands are installed.

The dielectric media may be disposed parallel to an ground plane, in which case the antenna may be fitted on a wall. In another advantageous layout, the primary sources are disposed along an axis about which said media has revolution symmetry. This being the case, it will be possible to make omnidirectional and/or multi-sector antennas of a reduced size.

DESCRIPTION OF PREFERRED EMBODIMENTS

Figure 1:
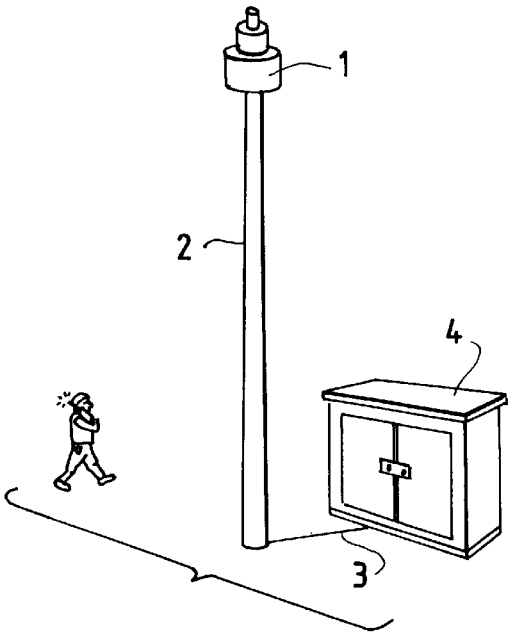
FIG. 1 is a diagram of a base station fitted with an antenna proposed by the invention.

FIG. 1 illustrates an antenna 1 according to the invention, installed at the top of a mast 2 (or any other structure) and connected to a base station 4 by means of cables 3.

Figure 2:
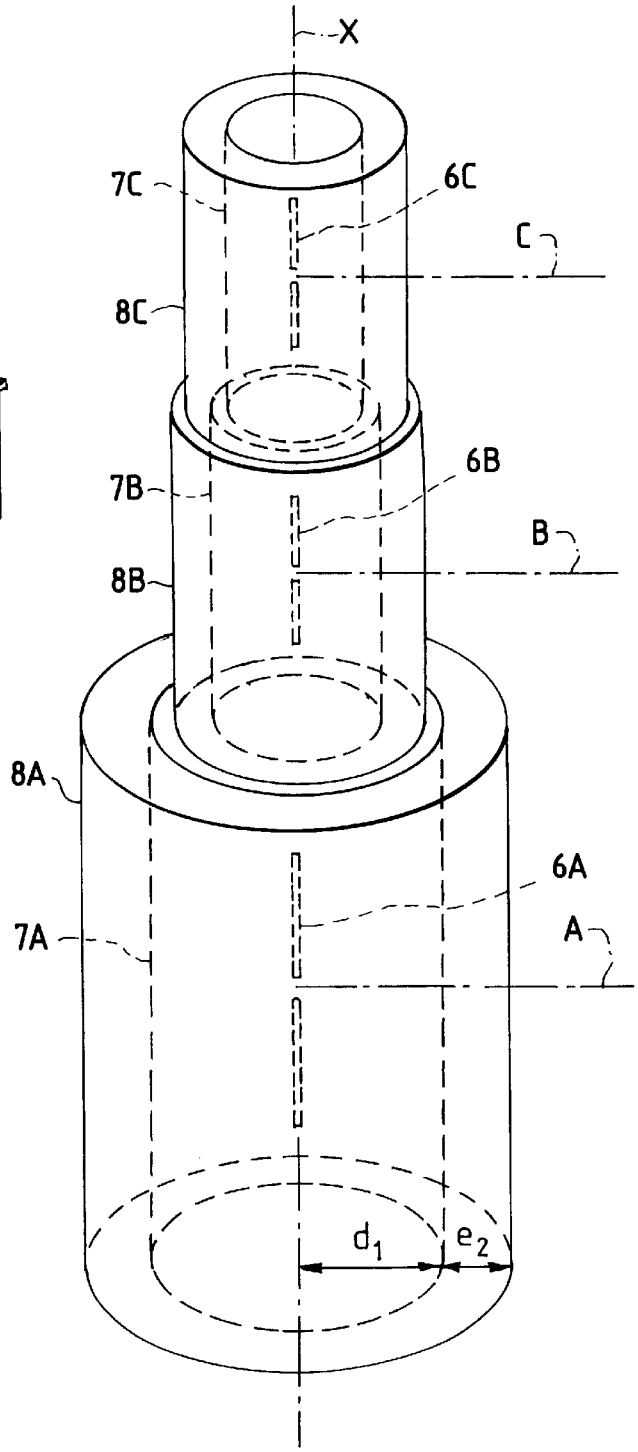
FIGS. 2 and 4 are perspective diagrams of an omnidirectional antenna and a three-sector antenna according to the invention.

In the example illustrated in FIG. 1, the antenna 1, shown in more detail in FIG. 2, is of the omnidirectional type and enables communication with mobile radio terminals in three separate frequency bands. By way of example, these might be the 900 MHz GSM band, the 1800 MHz DCS band and the 2000 MHz UMTS band. This being the case, the base station 4 in effect groups three base stations corresponding to the three types of network, and three coaxial cables (feeders) link these base stations to respective primary sources 6A, 6B, 6C of the antenna 1.

In the example illustrated in FIG. 2, each of the primary sources 6A–6C is a dipole tuned to a central frequency of the frequency band associated with said source. Each dipole is connected to its feeder (not shown in FIG. 2) in a conventional manner, by which it is fed independently of the other dipoles.

The three dipoles 6A–6C of the antenna of FIG. 2 are aligned on an axis X and surrounded by a focusing structure which is symmetrical in revolution about the axis X.

This focusing structure comprises a central medium having a relatively high characteristic impedance $Z_{c1}$ with regard to radio waves. If no magnetic materials are used ($\mu_1$=1), this central medium will simply be selected so as to exhibit a dielectric constant $\in_1$ close to 1 so that $Z_{c1}\approx Z_{c0}=120\pi$.

This high-impedance medium occupies a cylindrical region 7A, 7B, 7C around each dipole 6A, 6B, 6C, aligned and centered on this dipole. The axial height of each of these regions 7A–7C is in the order of the wavelength radiated by the corresponding dipoles 6A–6C. Its radius $d_1$ (indicated for region 7A only in FIG. 2) is of the form $\lambda_1.(2p_1-1)/4$, where $p_1$ is a positive integer preferably equal to 1, and $\lambda_1$ denotes the wavelength radiated by the dipole 6A, 6B, 6C in the medium having impedance $Z_{c1}$. The wavelength $\lambda_1$ is given by $\lambda_1=\lambda_0.\sqrt{\in_1.\mu_1}$, the wavelength $\lambda_0$ being that radiated in vacuum by the source 6A, 6B, 6C.

The high-impedance central medium 7A, 7B, 7C is surrounded by a focusing layer 8A, 8B, 8C formed by a medium having a relatively low characteristic impedance $Z_{c2}$. If no magnetic materials are used ($\mu_2$=1), a dielectric material with $\in_2>>1$ is chosen for the focusing layer 8A, 8B, 8C.

At the level of each source 6A, 6B, 6C, the thickness $e_2$ of the focusing layer 8A, 8B, 8C is taken as being equal to $\lambda_2.(2p_2-1)/4$, where p2 is a positive integer preferably equal to 1, and $\lambda_2=\lambda_0.\sqrt{\in_2.\mu_2}$ is the wavelength radiated by the corresponding source 6A, 6B, 6C in the low-impedance medium.

The high-impedance medium $Z_{c1}$ used in the antenna 1 may be air.

It may also be formed by means of a honeycomb or foam material, whose dielectric constant decreases with density (see <<Radome Engineering Handbook, Design and Principles>>, J. D. WALTON Jr., Editions Marcel Dekker Inc., New York, 1970). Such a material may be made from resins or polymers, for example of the polyester, epoxy, phenolic polyimide or polyurethane type.

For the focusing layers of low impedance $Z_{c2}$, organic materials may be used in particular, such as a polyester ($\in_r$ of 4 to 5), an epoxy ($\in_r\approx 4$) or a polyimide ($\in_r$=3.5).

If the cost of the antenna is not the most critical factor, materials with a very high permittivity may be used as an alternative, in particular inorganic compounds such as used in high-speed and high-temperature radomes, for example $Al_2O_3$ ($\in_r\approx 9$) or $TiO_2$ ($\in_r\approx 100$). Such materials may be diffused in a ceramic base matrix, for example in silica, enabling the value of $\in_r$ to be adjusted.

For reasons pertaining to cost and/or ease of manufacture, it may be practical to use composite dielectrics instead of natural dielectrics in order to obtain the desired values for the parameters $\in_r$ and $\mu_r$.

By <<natural dielectric>> is meant a pure dielectric compound or a mixture of pure dielectric compounds on a microscopic scale. For example, polystyrene ($\in_r$=2.5) or lead glass ($\in_r$=7).

A composite dielectric is a macroscopic assembly of discrete metal or dielectric particles, disposed regularly in three spatial dimensions and in various forms: spheres, discs, strips, rods or wires. The assembly is held together by a base: for example, the particles are coated in a homogeneous dielectric medium or disposed on dielectric plates. In each case, the index of the base is not much different from 1. If the dimensions of the particles and the distance between particles are small compared with the wavelength, the behavior of these assemblies will be identical to that of a natural dielectric. The weight, on the other hand, may be very much reduced and the dielectric constant can be quite finely adjusted.

The value of $\in_r$ for such an artificial dielectric is determined on a sample or by approximation formulae. For example, an arrangement made up of N metal spheres of a radius a per unit volume will give a dielectric constant of a value: $\in_r=1+4\pi Na^3$. It is thus possible to obtain an $\in_r$ ranging from 1 to 9.

For the media with high impedance $Z_{c1}$, it is possible to adjust the parameter $\mu_r$ in a similar way and obtain inexpensive, lightly magnetic, low loss composite materials with an appropriate concentration of iron particles in a base of plastics or resin material.

The focusing structure is assembled by a molding process, for example, once the sources 6A–6C and their feeders have been placed in position. If the mechanical strength of one or other of the dielectric media so requires, it may be reinforced, for example with glass fibers. It is also possible to use base, coating or protective elements provided they do not interfere with the electromagnetic behavior of the unit.

The focusing structure may also be made on a modular basis.

The largest dimension of the antenna 1 of FIG. 2 is its axial height which, in the example illustrated here, may remain in the order of 50 cm. The multi-frequency antenna therefore meets the requirement of a very compact system.

Each of the dipoles 6A, 6B, 6C has an omnidirectional radiation pattern, with a set of focusing directions A, B, C contained within the equatorial plane of the dipole. The above-mentioned resonance phenomenon enhances focusing of the waves transmitted by the dipoles 6A–6C in these directions A–C (elevation focusing). The gain in amplitude secured by the composite focusing structure is given by $2.Z_{c1}/Z_{c2}$. The power gain g, expressed in dB, is given by $g=20.\log_{10}(2.Z_{c1}/Zc_2)$. As may be seen, focusing gains of several decibels are readily obtained.

This gain may be increased by adding focusing layers of alternating high and low impedance.

Figure 3:
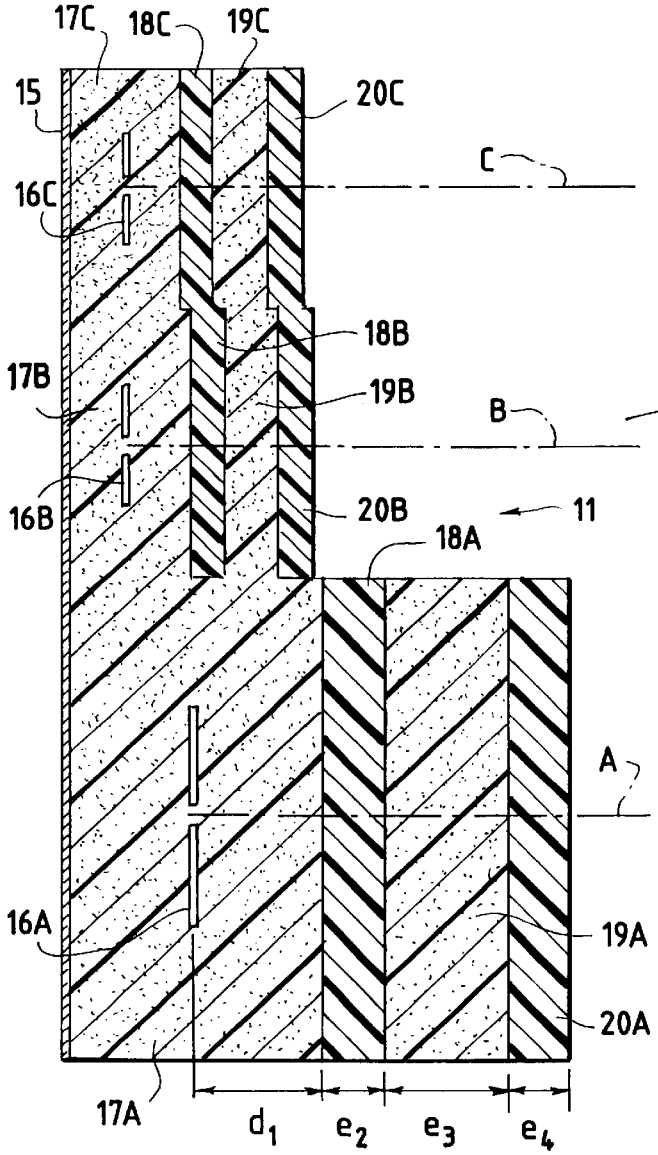
FIGS. 3 and 5 are lateral cross-sectional views of other antennas according to the invention.

The antenna 11 illustrated in FIG. 3 is of a generally flat design. The high-impedance medium 17A, 17B, 17C containing the dipoles (or other primary sources) 16A, 16B, 16C is deposited on a conductive ground plane 15. On a level with each source 16A, 16B, 16C, this medium 17A, 17B, 17C forms a layer of thickness $\lambda_1.(2q-1)/2$, $\lambda_1$ being the wavelength radiated in the medium by the relevant source and q a positive integer advantageously equal to 1. The distance $d_1$ between the source 16A, 16B, 16C and the interface with the first low-impedance focusing layer 18A, 18B, 18C is of the form $\lambda_1.(2p_1-1)/4$. The thickness $e_i$ of the (i−1)-th focusing layer ($i\geqq 2$) is of the form $\lambda_i.(2p_i-1)/4$. The successive focusing layers (18A, 19A, 20A), (18B, 19B, 20B), (18C, 19C, 20C) are of alternating low impedance and high impedance, i.e. for each odd integer i, the i-th focusing layer is formed by a medium whose characteristic impedance $Z_{c2}$ is lower than that $Z_{c1}$ of the media located on either side of this i-th layer.

The antenna 11 illustrated in FIG. 3 may be installed on a wall, for example, so as to radiate directively (directions A–C) towards a zone to be covered by the base station.

Figure 4:
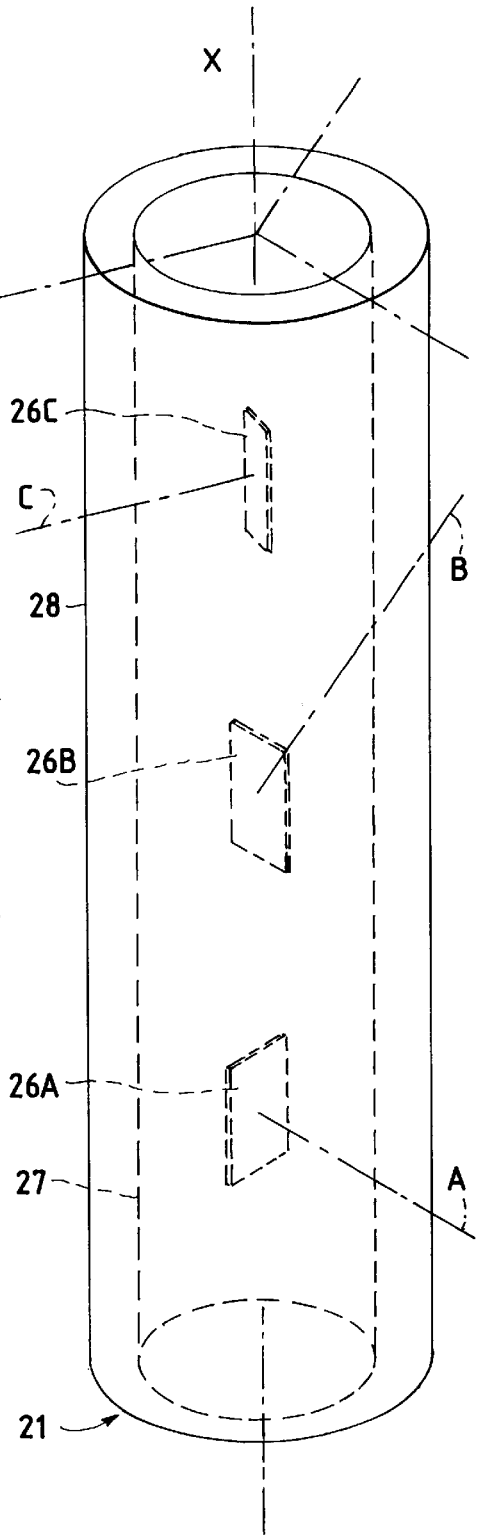

FIG. 4 is a schematic illustration of a multi-sector antenna made in accordance with the invention. The geometry of the focusing structure is symmetrical in revolution about the axis X along which three primary sources 26A, 26B, 26C are aligned. Each of these primary sources is for example provided in the form of a square conducting patch formed on a dielectric substrate (microstrip technology). This type of source has directivity in both azimuth and elevation, in a direction A, B, C perpendicular to the substrate. The focusing structure, of a cylindrical geometry, enables elevation focusing, and hence the gain of the antenna 21, to be enhanced. In order to limit the size of the sources 26A–26C at the core of the focusing structure, they may be formed on a substrate with a high $\in_r$.

In the example illustrated in FIG. 4, the three directive primary sources 26A–26C are tuned to the same frequency and are disposed along the axis X so that their focusing directions A–C are radial directions oriented at 120° relative to one another. The antenna therefore covers three sectors.

The high-impedance central medium 27 and the focusing layer 28 (and optionally subsequent layers not illustrated) have dimensions determined as mentioned above, taking account of the wavelength radiated by the sources 26A–26C.

It should be pointed out that it is possible to add an omnidirectional antenna such as a dipole to the primary sources 26A–26C forming a multi-sector antenna of the type illustrated in FIG. 4, thereby obtaining a combined antenna.

Figure 5:
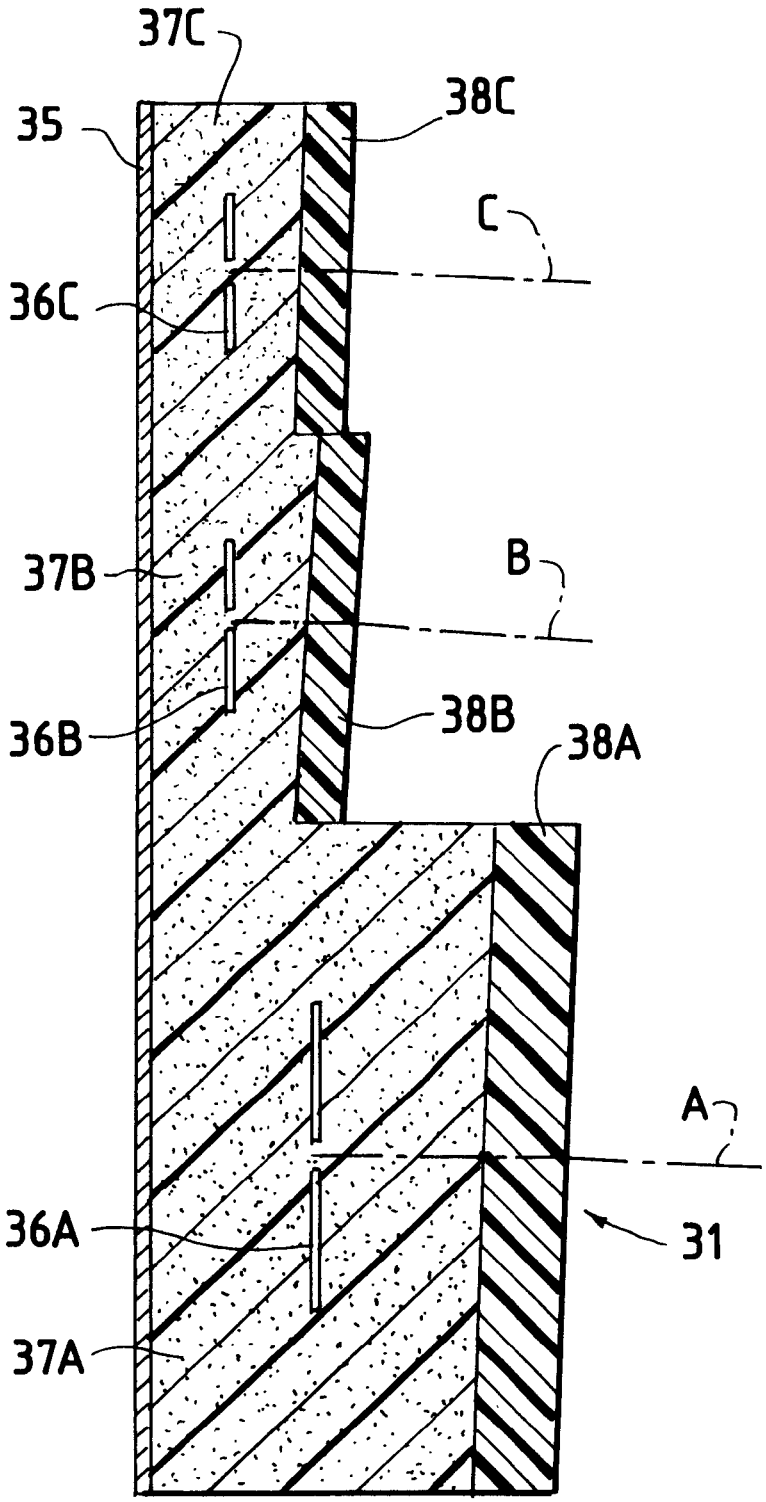

The antenna 31 illustrated in FIG. 5 is of a design generally similar to that of FIG. 3, with a single low-impedance focusing layer 38A, 38B, 38C over the high-impedance media 37A, 37B, 37C containing the dipoles 36A, 36B, 36C. The different media 37A–C, 38A–C fulfil to the above-discussed spatial resonance conditions. The interface between the successive media is inclined relative to the ground plane 35 and the primary sources 36A–C so that the refraction of the waves inclines the focusing directions A–C downwards in the example illustrated here. This enables the radiation pattern of the antenna to be adapted to suit requirements.

In another embodiment based on the same principle, the interfaces between dielectric layers are parallel with the earth plane and it is the dipoles which are inclined.

Naturally, the focusing directions could be inclined in a similar manner in the case of an antenna designed to be symmetrical in revolution of the type illustrated in FIG. 2 or 4, which will then be conical in shape rather than cylindrical.

An antenna according to the invention may be made using various types of primary sources (simple or crossed dipoles, slots, microstrip patterns), each disposed outside the transmission lobes of the others in order to ensure that they are electromagnetically decoupled from one another.

In the case of a multi-sector antenna, the primary sources may be placed on or conformed to a non-planar metal surface, for example a cylindrical or conical surface, which improves the forward-backward ratio of the antenna. The cylinder or cone bounded by this surface is symmetrical relative to the axis of the antenna. For example, it has a circular, triangular or polygonal section.

What is claimed is:

1. Antenna for a radio communication base station, comprising a plurality of primary sources fed independently and arranged to have different radiation characteristics, the primary sources being placed in a first medium so as to be spatially decoupled, the antenna further comprising at least one second medium covering the first medium and having a substantially lower characteristic impedance than the first medium, wherein each primary source has at least one direction of focus perpendicular to an interface between said first and second medium, along which the distance between said primary source and said interface is substantially equal to $\lambda_1.(2p_1-1)/4$ and the second medium has a thickness substantially equal to $\lambda_2.(2p_2-1)/4$, where $\lambda_1$ and $\lambda_2$ denote wavelengths radiated by said primary source in the first and second media, respectively, and $p_1$ and $p_2$ are integers.

2. Antenna according to claim 1, wherein the second medium has a dielectric constant substantially higher than the first medium.

3. Antenna according to claim 2, wherein the second medium comprises a composite dielectric material.

4. Antenna according to claim 1, wherein the first medium is covered by a superposition of focusing layers comprising a first focusing layer adjacent to the first medium and formed by said second medium, wherein each focusing layer is formed by a medium of a thickness substantially equal to $\lambda_i.(2p_i-1)/4$ along the direction of focus of each of the primary sources, where $\lambda_i$ denotes a wavelength radiated by said primary source in the medium forming said focusing layer and $p_i$ is an integer, and wherein the i-th focusing layer is formed, for each odd integer i, by a medium having a characteristic impedance substantially lower than the media located on either side of said i-th focusing layer.

5. Antenna according to claim 4, wherein the i-th focusing layer is formed, for each odd integer i, by a medium having a dielectric constant substantially higher than the media located on either side of said i-th focusing layer.

6. Antenna according to claim 5, wherein the i-th focusing layer is formed, for each odd integer i, by a medium comprising a composite dielectric material.

7. Antenna according to claim 4, wherein the i-th focusing layer is formed, for each odd integer i, by a medium comprising iron particles in a base of a plastics or resin material.

8. Antenna according to claim 1, wherein the primary sources comprise dipoles, radiating slots and/or microstrip patterns.

9. Antenna according to claim 1, wherein the primary sources are fed and arranged so as to radiate at different wavelengths.

10. Antenna according to claim 1, wherein the primary sources are placed along an axis about which said media have a revolution symmetry.

11. Antenna according to claim 10, wherein the primary sources comprise dipoles aligned on said axis.

12. Antenna according to claim 10, wherein several of the primary sources are fed and arranged so as to radiate at substantially the same wavelength and have directions of focus in elevation and azimuth oriented in distinct radial directions relative to said axis.

13. Antenna according to claim 12, wherein the primary sources are conformed on a non-planar metal surface.

14. Antenna according to claim 13, wherein said non-planar metal surface is cylindrical or conical with a symmetry relative to said axis.

15. Antenna according to claim 1, wherein the first medium and the second medium have an inclined interface relative to the primary source.

* * * * *